United States Patent [19]

Muller

[11] 4,371,760

[45] Feb. 1, 1983

[54] KEYBOARD SWITCH HAVING COMBINED ACTUATOR AND JUMPER CONTACT STRUCTURE

[75] Inventor: Michael Muller, Newport Beach, Calif.

[73] Assignee: Apple Computer, Inc., Cupertino, Calif.

[21] Appl. No.: 240,926

[22] Filed: Mar. 5, 1981

[51] Int. Cl.[3] ..... H01H 13/70

[52] U.S. Cl. ..... 200/5 A; 200/67 DA; 200/159 B

[58] Field of Search ..... 200/5 R, 5 A, 159 A, 200/159 B, 240, 242, 275, 292, 67 DB, 67 DA

[56] References Cited

U.S. PATENT DOCUMENTS

| | | | |
|---|---|---|---|
| 3,800,104 | 3/1974 | Lien et al. | 200/5 A |
| 3,870,840 | 3/1975 | Rivetta et al. | 200/5 A |
| 3,952,174 | 4/1976 | Boulanger et al. | 200/5 A |
| 4,029,916 | 6/1977 | Chu | 200/5 A |
| 4,032,729 | 6/1977 | Koistinen | 200/5 A |
| 4,090,045 | 5/1978 | Marsh | 200/5 A |
| 4,315,114 | 2/1982 | Monti, Jr. | 200/5 A |
| 4,316,066 | 2/1982 | Muller et al. | 200/5 A X |

*Primary Examiner*—J. R. Scott

*Attorney, Agent, or Firm*—Blakely, Sokoloff, Taylor & Zafman

[57] ABSTRACT

A device which provides a plurality of actuator members, for effecting switch closure in a sandwich keyboard formed with a printed circuit board having many electrical conductive paths thereon, with the actuator members being integrally formed with a connecting bus. The device is provided with a number of bendable fingers for making contact with any desired conductive path lying beneath the fingers thereby permitting the device to serve as a "jumper connector" without adding wire jumpers to the back of the printed circuit board. The actuator member is constructed to have self cleaning contact surfaces. A plurality of such actuators is preferably formed of a single strip of thin sheet metal.

15 Claims, 6 Drawing Figures

KEYBOARD SWITCH HAVING COMBINED ACTUATOR AND JUMPER CONTACT STRUCTURE

SUMMARY OF THE INVENTION

A switch contactor assembly, such as found in typical printed circuit keyboard switch assemblies, is formed from a thin sheet of metal to provide an actuator with two depending self-cleaning contactor fingers for insuring reliable switch closure. The actuator is connected through a connecting arm and an anchor post to a bus which is integrally connected to a plurality of such actuators. The contactor assembly may further serve as a jumper device by providing each anchor post with a pair of first jumper contact fingers and providing the bus with an equal number of second jumper contact fingers. The jumper contact fingers are positioned such that a connection may be made between desired circuit conductor points by appropriate bending of a first jumper contact finger and an appropriate second jumper contact finger (on the bus) thereby electrically connecting the points without the use of a jumper wire, which in the prior art, was secured to the opposite side of the circuit board to accomplish the same jumper connection.

DETAILED DESCRIPTION OF THE INVENTION

Figure 1:
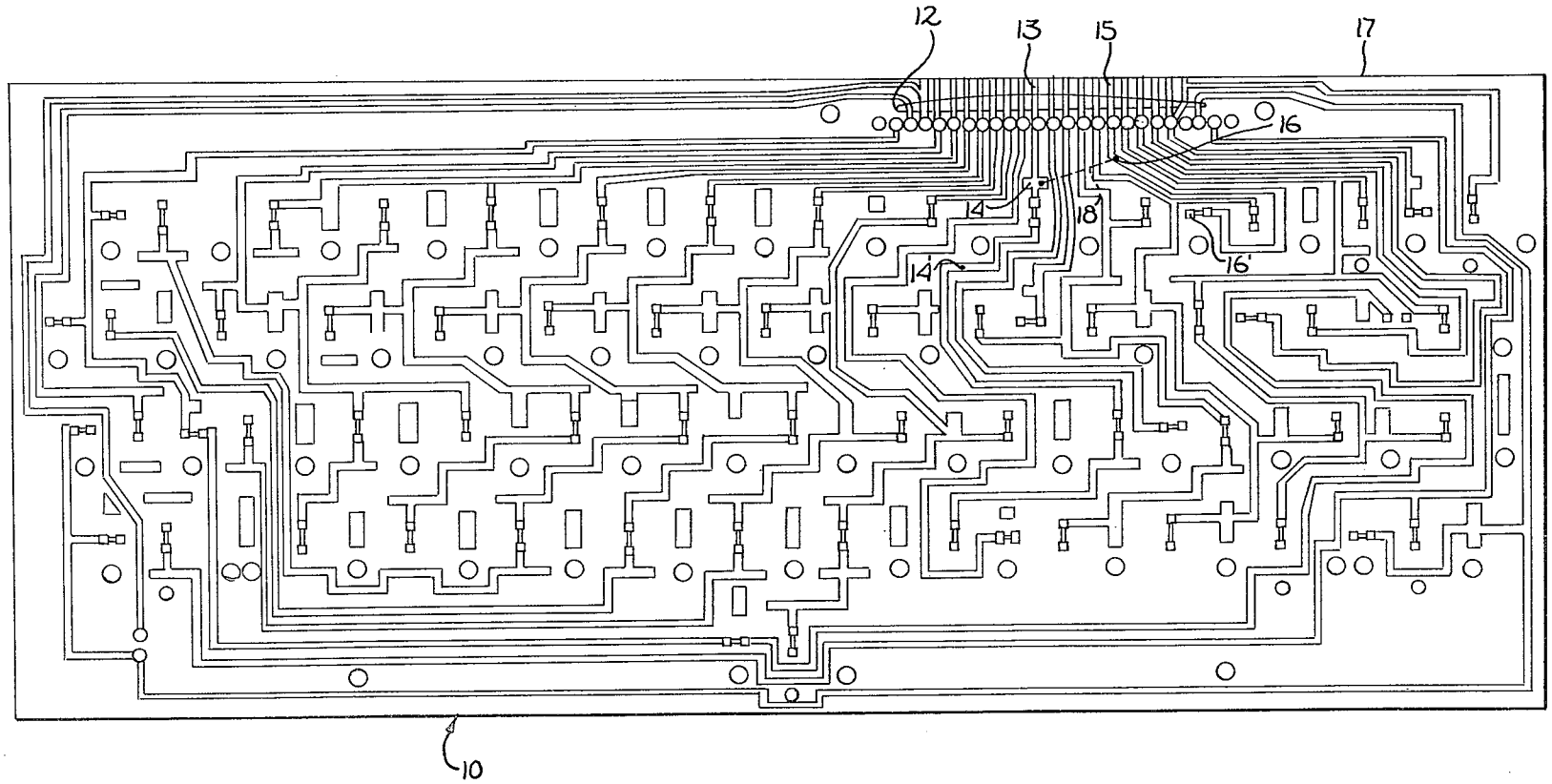
FIG. 1 is a plan view of a printed circuit board showing a plurality of conductive paths on one side thereof.
Figure 2:
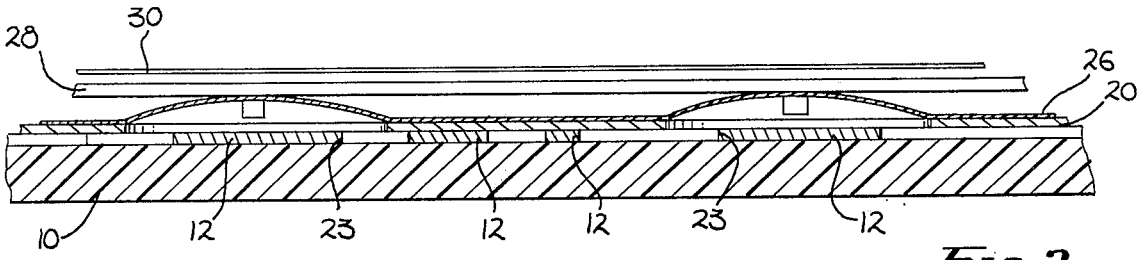
FIG. 2 is a partial cross sectional view of a keyboard constructed to employ the contactor assembly of the present invention.

The invention is a switch contactor assembly as is typically found in sandwich keyboards formed in conjunction with a printed circuit board such as shown in FIGS. 1 and 2. A typical printed circuit board 10 is provided with a plurality of printed circuit conductor paths 12 according to techniques well known in the art. It is not uncommon for the pattern of such paths 12 to become particularly complex. If it later becomes desirable to electrically connect two paths, it may be very difficult, if not impossible, to connect the paths by adding another path. To make such a connection, it is common practice to drill a hole through the board 10 and to each path 12 which are to be connected together. A wire is then placed on the back of the board 10 with one end of the wire passing through each hole and contacting one of the paths. The wire is then appropriately affixed. Such a connection of paths is shown in FIG. 1. The path pattern is so dense that a separate path connecting paths 13 and 15 is impractical. Holes were drilled at points 14 and 16 through board 10 to the respective paths. Wire 18 was placed on the back of board 10 and one end of wire 18 passed through each hole to electrically connect points 14 and 16.

Jumper connections made by the method illustrated by wire 18 are common and in most situations are easily made without serious penalty. In certain applications, the addition of wires to the back of the board 10 increases the thickness of the finished product beyond that desired. Such is the case with sandwich type keyboards where the board must be kept as thin as possible. A cross section of such a sandwich keyboard employing the contactor assembly of the present invention (as shown in FIGS. 3 and 4) is shown in FIG. 2.

A printed circuit board 10 is provided with a plurality of electrically conductive paths 12. A thin layer of insulative material (not shown) may be sprayed or otherwise applied over the paths, with openings in the insulative layer at appropriate locations to permit making electrical contact at preselected contact points on the paths. A relatively thin spacer 20, which may be a heavy weight paper sheet, is positioned over the insulative layer. The spacer has apertures such as 22 and 23 therethrough aligned over the contact points of paths 12.

A contactor assembly 26 is placed above the spacer 20 and aligned such that operation of the contactor assembly will cause a portion (such as depending fingers 34 and 35 of FIG. 6) of the contactor assembly to pass through an aperture of the spacer 20 and make electrical contact with a contact point of a particular path 12. Above the connector assembly 26 is placed a sheet of silicon rubber 28 or other suitable material which is the same size as the board 10 and is sealed to the board 10 around its edges. Over the surface of the sheet of silicon rubber 28 is placed a thin sheet of Mylar 30 or other flexible sheet material on which printing can be done, e.g., polycarbonate, having indicia thereon to indicate the location and interpretation of each particular switch on the board.

Figure 3:
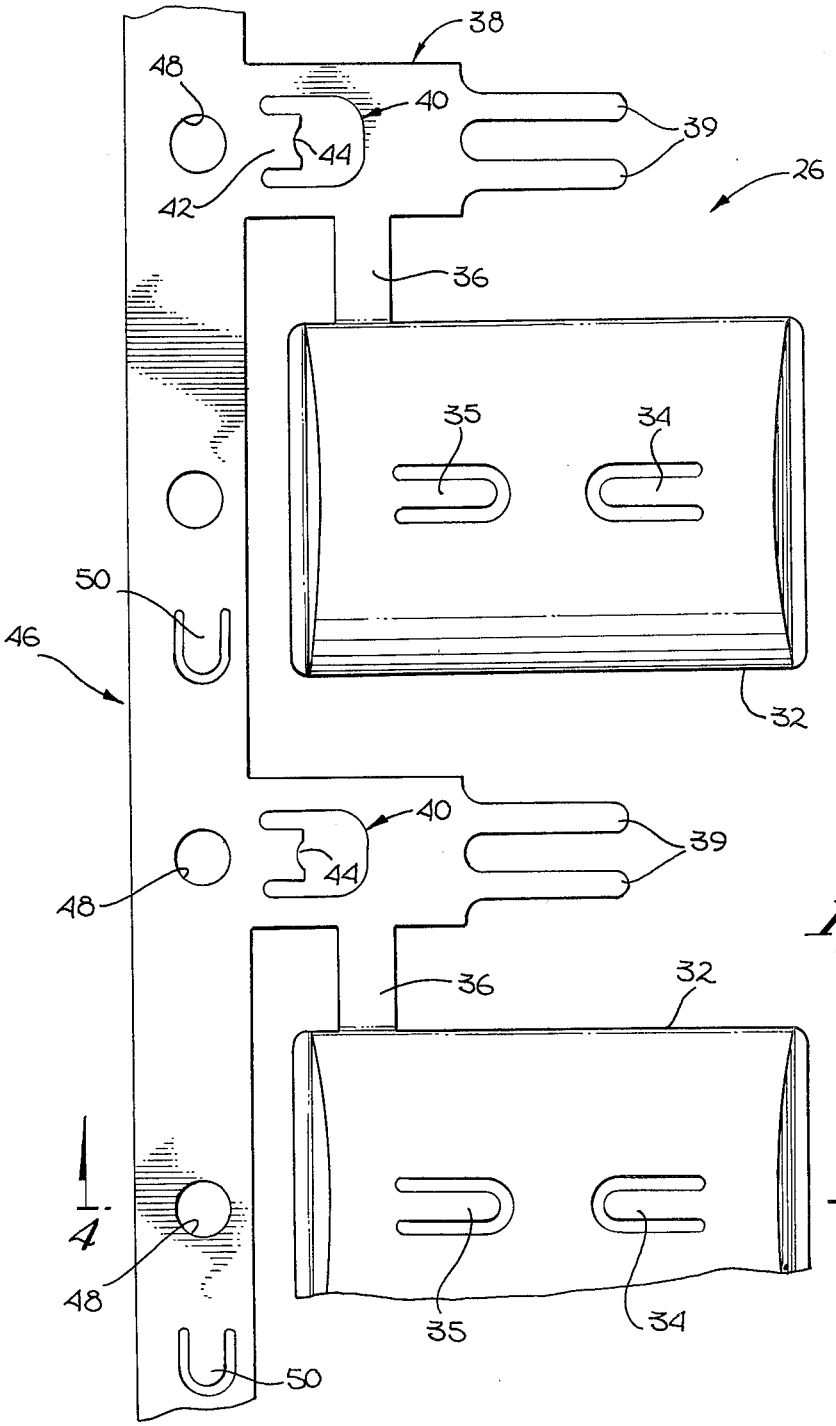
FIG. 3 is a top plan view of a typical switch actuator and connecting elements of the contactor assembly.
Figure 4:
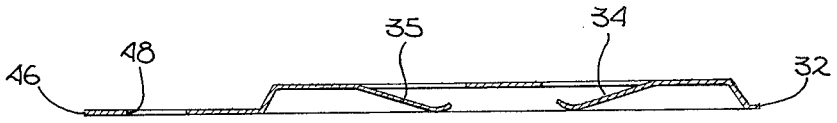
FIG. 4 is an edge on view taken along the line 4—4 of FIG. 3.

The unique configuration of the present contactor assembly 26, used in such a sandwich keyboard, is shown in FIGS. 3 and 4. This configuration allows jumper connections to be made on the same side of the circuit board 10 as the printed circuit conductor paths 12 without increasing the thickness of the board 10. It also achieves reliable switch closure by use of a double fingered actuator 32 which wipes and cleans its contact surface with each actuation.

The contactor assembly 26 comprises a plurality of actuators 32, each having depending contactor fingers 34 and 35. Each actuator 32 is joined by a respective connecting arm 36 and anchor post 38, to a bus 46. The anchor post 38 is provided with a first jumper contactor finger 39 which may in fact be a pair of such fingers 39. The anchor post 38 also has an alignment hole cutout 40 provided with a gripping tab 42. Tab 42 has an arcuate recess 44 to better grip an alignment pin (not shown) of the board 10.

Bus 46 integrally joins a plurality of anchor posts 38 to form a strip of interconnected actuators 32. The bus 46 is provided with a plurality of second jumper contact fingers 50 evenly spaced along the length of the bus 46.

By bending a selected pair of contactor fingers (39 or 50) toward printed circuit board 10 and through the spacer 20, a jumper connection can be made between any two paths 12 passing beneath any jumper fingers 39 or 50 and contactor fingers 34 and 35.

Figure 5:
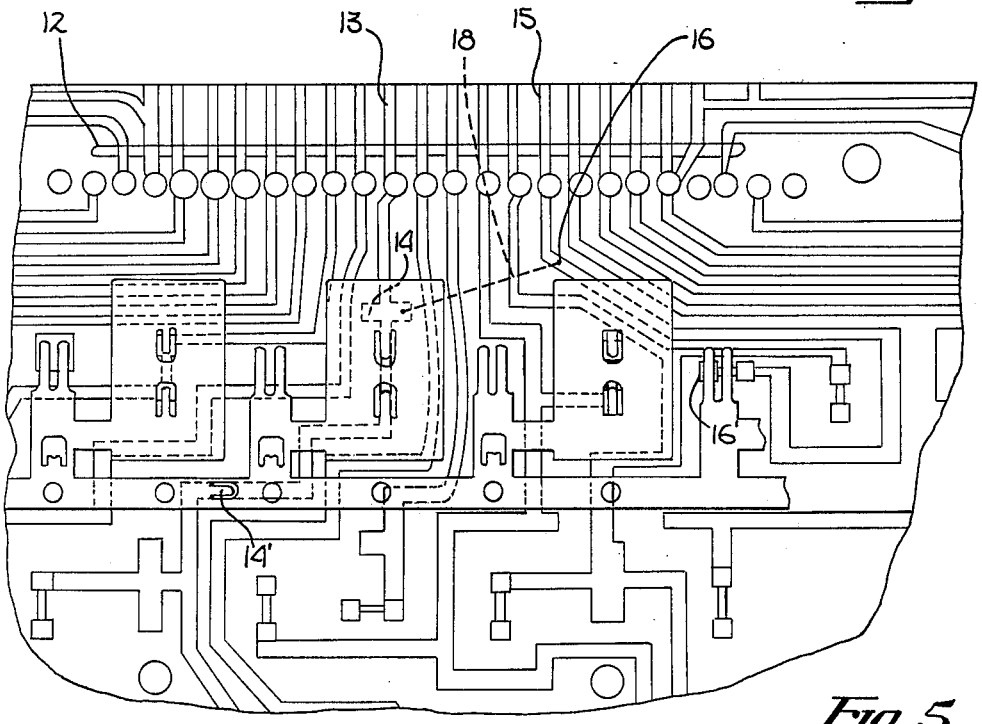
FIG. 5 is a top plan view of the contactor assembly positioned over the conductor paths of the printed circuit board.

As an illustration of the jumper connection feature of this assembly 26 of interconnected contactors, reference may be had to FIGS. 1 and 5. FIG. 1 shows the usual wire 18 mounted on the back of board 10 forming a jumper connection between paths 13 and 15 at points 14 and 16 respectively. FIG. 5 shows an enlarged view of that same portion of the circuit board 10 with the contactor assembly 26 of the present invention aligned thereover. A jumper connection, electrically equivalent to that of wire 18 in FIG. 1, may be effected by the contactor assembly 26 shown in FIG. 5 by bending fingers 39' and 50' toward exposed portions 14' and 16' of paths 13 and 15 respectively lying therebeneath. Such a jumper connection does not increase the thickness of the resulting keyboard and does not produce sharp pointed wire projections, as are produced by wire 18, which projections can later be filed smooth. The efficiency of making jumper connections has thus been greatly increased.

Figure 6:
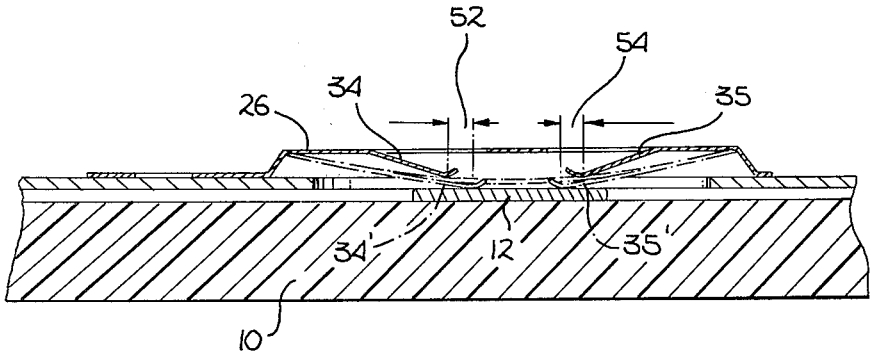
FIG. 6 is a partial sectional view taken along the line 6—6 of FIG. 5.

The self cleaning feature of the actuator 26 is best illustrated in FIG. 6. The actuator 26 is aligned over an appropriate contact pad of a path 12 such that depression of the actuator 26 causes contactor fingers 34 and 35 (which may be gold plated or may be plated with an other suitable material) to make electrical contact with path 12. As the actuator is further depressed, the free end of contactor fingers 34 and 35 are caused to travel slightly toward one another wiping the contact surface of path 12. This wiping insures a clean contact surface each time an actuator is operated. The distance traveled may be relatively short, such as shown by distances 52 and 54, and still maintain a clean contact surface.

The use of two contactor fingers 34 and 35, to make contact with a single electrical path 12, improves the reliability of the switch closure. Even in the event that one of the fingers 34 or 35 becomes folded, such as during manufacture or during use, and unable to make electrical contact, the other will be able to make the required contact.

The bent position of contact fingers 34 and 35 and their inherent resiliency, causes the fingers to exhibit some "give" when contact is made and thus such an actuator 32 exhibits less sensitivity to "bounce" than does a single point of contact made by an over center acting disk type switch.

There has thus been described a reliable keyboard "switch" assembly for use in the very thin "sandwich" type of keyboard which employs a contactor assembly which also may function as an efficient jumper connector without increasing the thickness of the "sandwich" as a result of the jumper connection. While the invention has been described with specific reference to FIGS. 1 through 6 herein, such description and Figures are intended to illustrate, rather than limit, the nature of the invention. It is to be understood that many changes in material and configuration could be made to the invention by one of ordinary skill in the art without departing from the spirit and scope of the invention which is intended to be defined only be the appended claims.

What is claimed is:

1. In a sandwich type keyboard switch assembly including a printed circuit board with printed circuit conductors thereon, an apertured separator overlying said printed circuit board, a contactor assembly overlying said separator, and a cover layer and indicia member overlying said contactor assembly, an improved contactor assembly comprising:

a plurality of actuators each of which is provided with at least two depending contact fingers, the free ends of which are bent such that they are at least in part substantially parallel to the surface of a printed circuit conductor therebeneath, with the larger portion of the length of said contact fingers disposed at an angle with the plane of said actuator, whereby depression of said actuator will cause said fingers to pass through an aperture in said separator and make electrical contact with the same circuit conductor on said printed circuit board, and further depressing of said actuator will cause the free end of said contact fingers to move laterally across the surface of said circuit conductor;

contact jumper means integrally formed with said plurality of actuators for selectively electrically coupling circuit conductors disposed on said printed circuit board;

each of said actuators being integrally formed with and electrically connected to a bus.

2. The improvement according to claim 1 wherein the free ends of said at least two depending contact fingers are closest to one another and the opposite end of said contact fingers are farthest from one another with the lengths of at least two of said contact fingers being co-linear.

3. The improvement according to claim 2 wherein the free end of each of said at least two depending contact fingers is gold plated.

4. The improvement according to claim 1 wherein each of said plurality of actuators is integrally joined to said bus through an anchor post;

said anchor post being provided with a first jumper contact selectively bendable to extend through said separator to make electrical contact with a first conductor therebeneath on said printed circuit board;

said bus being provided with a plurality of second jumper contacts selectively bendable to extend through said separator to make electrical contact with a second conductor therebeneath on said printed circuit board, whereby said first conductor is electrically jumper connected to said second conductor.

5. The improvement according to claim 4 wherein said first jumper contact comprises a pair of parallel contact fingers.

6. The improvement according to claim 4 the first jumper contact is gold plated.

7. The improvement according to claim 4 wherein said anchor post is provided with a cutout therein and a gripper having a curved edge for gripping the curved surface of an anchor pin.

8. The improvement according to claim 5 wherein said pair of parallel contact fingers are lengthwise parallel to said at least two depending contact fingers.

9. The improvement according to claim 5 wherein said second jumper contacts comprise a second contact finger cutout having its length parallel to the length of said bus.

10. The improvement according to claim 9 wherein the length of said at least a pair of parallel contact fingers lies perpendicular to the length of said bus.

11. In a sandwich type keyboard switch assembly including a printed circuit board with printed circuit conductors thereon, an apertured separator overlying said printed circuit board, a contactor assembly overlying said separator, and a cover layer and indicia member overlying said contactor assembly, an improved contactor assembly comprising:

a plurality of actuators each integrally formed with and electrically connected through a respective anchor post to a common bus;

said anchor post being provided with first jumper contact fingers selectively bendable to extend through said separator to make electrical contact with a first conductor on said printed circuit board;

said bus being provided with a plurality of second jumper contacts selectively bendable to extend through said separator to make electrical contact with a second conductor on said printed circuit board, whereby said first conductor is electrically coupled to said second conductor.

12. The improvement according to claim 11 wherein said first jumper contact fingers are gold plated.

13. The improvement according to claim 12 wherein said anchor post is provided with a cutout therein and a gripper having a curved edge for gripping the curved surface of an anchor pin.

14. The improvement to claim 13 wherein said second jumper contacts comprise a second contact finger cutout having its length parallel to the length of said bus.

15. The improvement according to claim 14 wherein the length of said contact fingers lies perpendicular to the length of said bus.

* * * * *